US012215962B2

(12) United States Patent
Binns et al.

(10) Patent No.: US 12,215,962 B2
(45) Date of Patent: Feb. 4, 2025

(54) ENERGY HARVESTING ASSEMBLIES

(71) Applicant: BAE SYSTEMS plc, London (GB)

(72) Inventors: Richard Binns, Chelmsford (GB); Daniel Phillip Crane, Chelmsford (GB); Mohammed-Asif Akhmad, Chelmsford (GB)

(73) Assignee: BAE SYSTEMS PLC, London (GB)

( * ) Notice: Subject to any disclaimer, the term of this patent is extended or adjusted under 35 U.S.C. 154(b) by 3 days.

(21) Appl. No.: 18/257,893

(22) PCT Filed: Dec. 15, 2021

(86) PCT No.: PCT/GB2021/053303
§ 371 (c)(1),
(2) Date: Jun. 16, 2023

(87) PCT Pub. No.: WO2022/129901
PCT Pub. Date: Jun. 23, 2022

(65) Prior Publication Data

US 2024/0053128 A1 Feb. 15, 2024

(30) Foreign Application Priority Data

Dec. 16, 2020 (EP) ..... 20275186
Dec. 16, 2020 (GB) ..... 2019893

(51) Int. Cl.
*F42C 15/295* (2006.01)
*F42B 12/38* (2006.01)

(52) U.S. Cl.
CPC ..... *F42C 15/295* (2013.01); *F42B 12/382* (2013.01)

(58) Field of Classification Search
CPC ..... F42C 15/295; F42B 12/382
USPC ..... 102/458, 513
See application file for complete search history.

(56) References Cited

U.S. PATENT DOCUMENTS 2,766,964 A * 10/1956 Almquist ..... F01D 7/02 416/186 A
3,093,076 A 6/1963 Blomgren
3,377,954 A * 4/1968 Rabinow ..... F42C 15/295 102/208
3,401,635 A 9/1968 Rabinow
3,841,220 A * 10/1974 Murphy ..... F42C 15/29 102/224

(Continued)

FOREIGN PATENT DOCUMENTS

FR 2796456 A1 * 1/2001 ..... F42C 15/29
GB 1351666 A 5/1974
WO 2022129901 A1 6/2022

OTHER PUBLICATIONS

International Search Report and Written Opinion received for PCT/GB2021/053303. Mailed: Jan. 28, 2022. 13 pages.

(Continued)

*Primary Examiner* — Bret Hayes
(74) *Attorney, Agent, or Firm* — Finch & Maloney PLLC

(57) ABSTRACT

According to some examples, an energy harvesting assembly for a projectile comprises an inlet provided at the tip of a casing of the projectile, multiple outlets provided circumferentially around an outer surface of the casing proximate the tip, and an airflow channel structure extending from the inlet in a generally axial direction through a turbine to the multiple outlets.

14 Claims, 3 Drawing Sheets

(56) References Cited

U.S. PATENT DOCUMENTS

| | | | | |
|---|---|---|---|---|
| 4,002,123 | A * | 1/1977 | Fisher | F42C 15/295 102/226 |
| 4,665,332 | A * | 5/1987 | Meir | H02K 21/125 416/169 R |
| 6,880,467 | B1 * | 4/2005 | Knapp | F42B 12/36 102/458 |
| 2005/0016408 | A1 | 1/2005 | Smith et al. | |
| 2020/0292287 | A1 | 9/2020 | Thoren et al. | |

OTHER PUBLICATIONS

Combined Search and Examination Report under Sections 17 and 18(3) received for GB Application No. 2019893.3, dated Jun. 10, 2021. 6 pages.

Extended EP Search Report received for EP Application No. 20275186.3, dated Jun. 8, 2021. 8 pages.

* cited by examiner

ENERGY HARVESTING ASSEMBLIES

TECHNICAL FIELD

Aspects relate, in general, to an energy harvesting assembly, and more specifically, although not exclusively to an energy harvesting assembly for a non-incendiary projectile.

BACKGROUND

A projectile, such as a bullet, can be propelled from the barrel of a gun using propellant in the form of, e.g., a chemical explosive. The projectile can reach speeds in excess of 1000 mph. Some projectiles, typically termed tracers or tracer rounds, can be used to provide a visible trajectory to enable the flight path of the projectile to be determined. The visible trajectory thus enables a user to visualise the path of the projectile, and to make ballistic alterations so as to correct the flight path and thus ultimately the end impact point of the projectile. Such projectiles can comprise a pyrotechnic composition that is ignited when the round is fired. The composition is such that the visible trajectory can be seen by the naked eye in daylight as well as night-time. The pyrotechnic composition, being incendiary in nature, can be unintentionally ignited. Furthermore, such compositions can be unreliable in terms of, e.g., the nature of light produced and the duration over which the composition burns due to variations that may occur during manufacture or storage.

SUMMARY

According to a first aspect, there is provided an energy harvesting assembly for a projectile, comprising an inlet provided at the tip of a casing of the projectile, multiple outlets provided circumferentially around an outer surface of the casing proximate the tip, an airflow channel structure extending from the inlet in a generally axial direction through a turbine to the multiple outlets.

Movement of air through the airflow channel structure from inlet to outlets provokes rotation of the turbine as the airflow passes over a set of angled turbine blades. In an implementation of the first aspect, a generator coupled to the turbine can be used to convert energy from a fluid flow through the airflow channel to electrical energy for powering a payload of the projectile. That is, energy generated by the turbine can be used to power one or more electrical components of the projectile. The inlet defines an intake for an internal inlet channel of the assembly arranged along an axial direction of the projectile. The inlet channel receives an airflow as the projectile moves (in a direction that is generally parallel to the axis that runs from its tip to its tail), which airflow passes through the remainder of the airflow channel structure to the outlets.

The outlets can be provided at respective terminal ends of multiple outlet channels of the assembly, each outlet channel being arranged at an obtuse angle with respect to an axis of the projectile. That is, an outlet can define an aperture in the surface of the projectile.

In an implementation of the first aspect, the turbine comprises n turbine blades, and $n \neq m$, where m is the number of outlets. The number of blades is different to the number of outlets in order to avoid deconstructive air turbulence effects, which would otherwise occur if there were the same number of these elements (i.e., the same number of blades and outlets).

The turbine blades can have a pitch in the range 15-30 degrees. That is, the turbine blades can have a relatively shallow pitch in order to regulate the rate of rotation of the turbine so that it does not spin too fast, for example, which may cause damage to the turbine and/or projectile.

The turbine is so arranged as to rotate in a predetermined direction of rotation. The direction of rotation is different to a direction of rotation of the projectile, in use. The multiple outlets are arranged at angle, relative to the axis of the projectile. The outlets are defined by channels of the airflow channel structure, terminating in apertures in the outer surface of the casing. For example, the outlet channels of the airflow channel structure are arranged at angle relative to the long axis of the projectile (i.e., the axis from tip to tail of the projectile). As such, the openings may be elliptical in shape on the surface of the projectile.

In an implementation of the first aspect, a mesh provided can be structure over or within the inlet.

According to a second aspect, there is provided a projectile comprising an energy harvesting assembly as provided in accordance with the first aspect. The projectile may be a non-incendiary projectile, such as a non-incendiary tracer for example. The projectile can further comprise a component to be powered using power generated by the energy harvesting assembly.

In an implementation of the second aspect, the energy harvesting assembly can generate power for an illumination source configured to emit electromagnetic radiation from an aperture in the base of the projectile, whereby to enable the projectile to be detected. The turbine can rotate in a predefined direction, which direction is opposite to a direction of rotation of the projectile, in use.

BRIEF DESCRIPTION OF THE DRAWINGS

Embodiments will now be described, by way of example only, with reference to the accompanying drawings, in which.

DESCRIPTION

Figure 1:
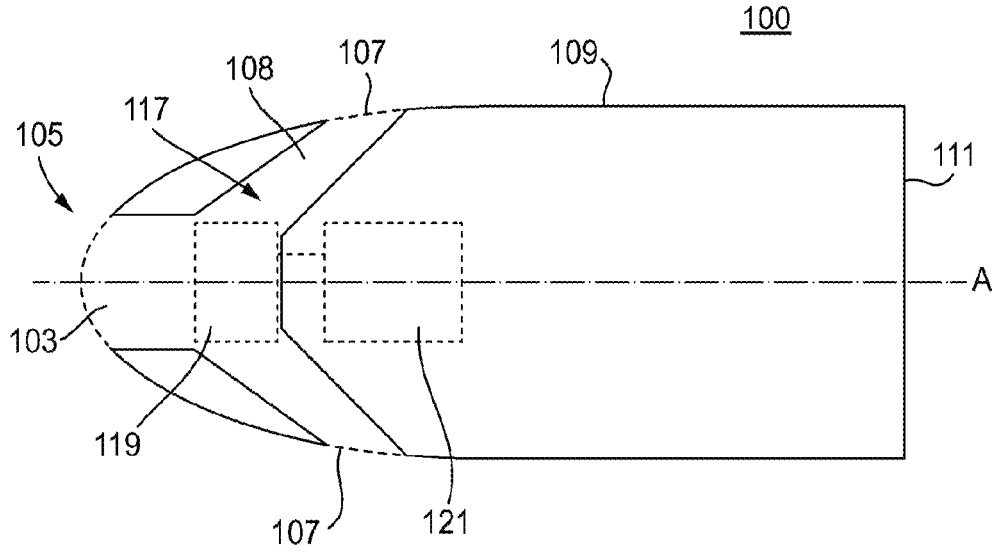
FIGS. 1 to 4 are schematic representations of a projectile according to an example.

Example embodiments are described below in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

The use of pyrotechnic compositions in, e.g., incendiary tracers means that the location of the shooter can easily be determined by simple visual inspection of the starting point of the visible path that has been caused by ignition of the pyrotechnic agent in question, particularly since the light that is emitted is visible over a large number of viewing angles due to scattering of light in the smoke trail resulting from combustion of the pyrotechnic composition. This can be detrimental to a user if there are hostile observers in the vicinity. Nevertheless, the pyrotechnic compositions used are incapable of being modified tuned to overcome this drawback. Furthermore, since the pyrotechnic composition is gradually exhausted as the tracer is in flight, the trajectory will alter in a manner that is different to that of non-tracer projectiles. This is in addition to the issue noted above with respect to storage and manufacture.

Non-incendiary projectile tracers—that is, tracers that do not use pyrotechnic compositions to generate a visible path of the trajectory of the tracer—can be utilised in order to overcome some of the issues noted above. For example, a rearwardly directed electrically powered light source that is configured to emit light as the tracer is in flight can be used. However, in order to power such a light source, potentially volatile chemical-based power sources may be typically used, such as batteries or other power sources using an electrochemical activation mechanism in which, e.g., an electrochemical cell can be initiated by rupturing a container comprising an electrolyte. Initiation of the electrochemical cell is typically induced by the rapid acceleration associated with firing the projectile, which causes the container to break. Of course, the use of such power sources, whilst removing some of the issues surrounding the use of incendiary tracers, introduces other issues that stem from the nature of the electrochemical substances in use, including volatility and degradation.

According to an example, there is provided an energy harvesting assembly. The energy harvesting assembly can be used to generate power for use by one or more electrically dependent systems or devices of a projectile, such as a non-incendiary projectile or tracer. For example, the energy harvesting assembly can be used to generate power for a light source that is provided to generate a detectable trail for a projectile over at least a portion of its trajectory. The energy harvesting assembly can be used to generate power that may be used for other electrically dependent components of a projectile.

In an example, the energy harvesting assembly comprises an inlet provided at the tip of a casing of the projectile, and multiple outlets provided circumferentially around an outer surface of the casing proximate the tip. An airflow channel structure is provided that extends from the inlet in a generally axial direction through a turbine to the multiple outlets. Accordingly, an airflow, induced by movement of the projectile, passes along the airflow channel structure from the inlet to the outlets. As it does so, it passes the turbine, which can be provided in fluid communication with the airflow channel structure such that an induced airflow triggers motion of the turbine, whence power can be generated. In an example, the turbine can be provided within the airflow channel structure.

FIG. 1 is a schematic representation of a projectile according to an example. The projectile 100 may form part of a larger cartridge (not shown) comprising a housing for a propellant that can be ignited using a primer in order to propel the projectile 100. Inlet 103 is provided at the tip 105 of the projectile. That is, inlet 103 is provided at a point of the projectile that enables ingress of air as the projectile moves in a generally axial direction A. The inlet 103 can be provided with a mesh cover (e.g., just within the inlet) to ensure that debris cannot get lodged therein during handling and storage, which could affect operation when fired.

In the example of FIG. 1, two outlets 107 are depicted, each of which is shown on opposite sides of the projectile. More than two outlets, in fluid communication with inlet 103, can be provided. Outlets 107 are provided circumferentially around a casing 109 of the projectile 100, proximate the tip. That is, outlets 107 are, in the example of FIG. 1, provided closer to the tip 105 of the projectile 100 than they are to its base III. However, the outlets may be placed in any desired location providing that they do not interfere with, e.g., a full metal jacket placed on the projectile. In an example, the outlets 107 are defined by channels 108 that terminate in apertures in the casing 109. The channels 108 are raked with respect to the axis A towards end 111.

Airflow channel structure 117 extends from the inlet 103 in a generally axial direction A through a turbine 119 to the multiple outlets 107. The airflow channel structure 117 defines a set of interconnecting cavities within the projectile 100 that enable a fluid to flow between the inlet 103 and the outlets 107. That is, as the projectile 100 moves in a generally axial direction A, such as after having been fired by a gun, air enters the inlet 103, passes through the airflow channel structure 117 and exits via the outlets 107. Rotation of the projectile 100 about the axis A has no adverse effect on this passage of air through the airflow channel structure 117. As it moves through the airflow channel structure 117, air passes over the turbine 119. This airflow over the turbine can be used to provoke movement of a set of turbine blades (not shown in FIG. 1), which can be linked, via a shaft, to a generator comprising stator and rotor components configured to generate an electrical current as a result of rotation of the shaft to which the blades of the turbine are attached. Thus, movement of the projectile 100 provokes an airflow to pass through the airflow channel structure 117, which can be used to generate power using turbine 119. The power generated by turbine 119 can be used to power a component 121 of the projectile, such as a light source for example.

Figure 2:
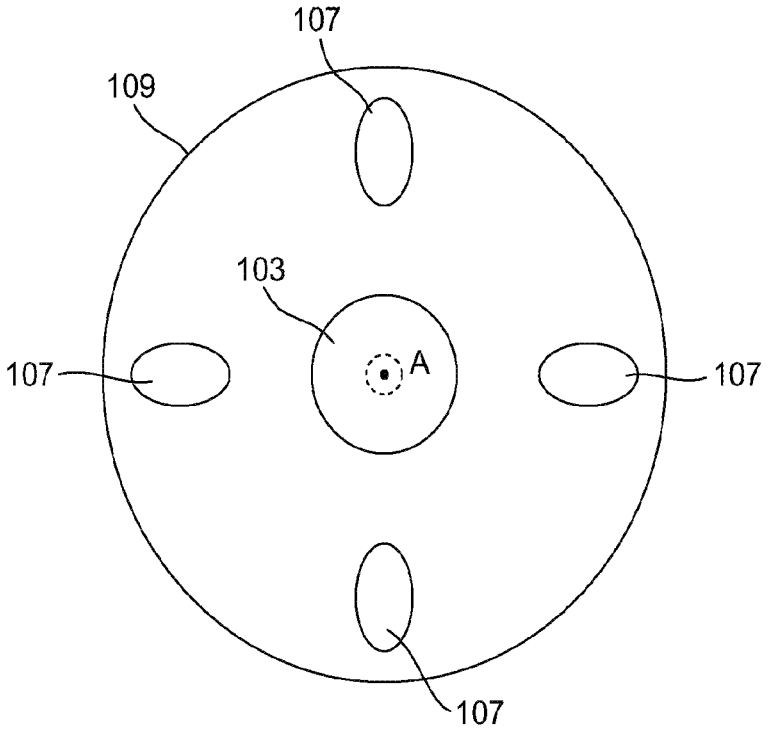

FIG. 2 is a schematic representation of a projectile according to an example. The projectile of FIG. 2 is shown in a direction towards the tip, i.e. head on. The inlet 103 and outlets 107 are visible. As shown in FIG. 2, multiple (four in this case) outlets 107 are provided circumferentially around the casing of the projectile. Although one inlet has been depicted in FIGS. 1 and 2, it is possible for more than one to be provided at the tip of the projectile.

According to an example, the number of outlets is greater than the number of inlets.

Figure 3:
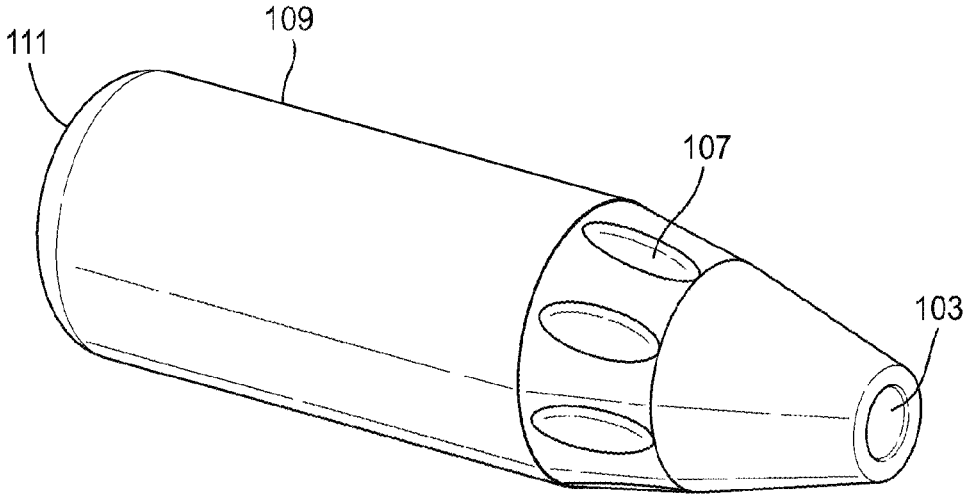

FIG. 3 is a schematic representation of a projectile according to an example. The projectile of FIG. 3 is shown in a perspective view.

Figure 4:
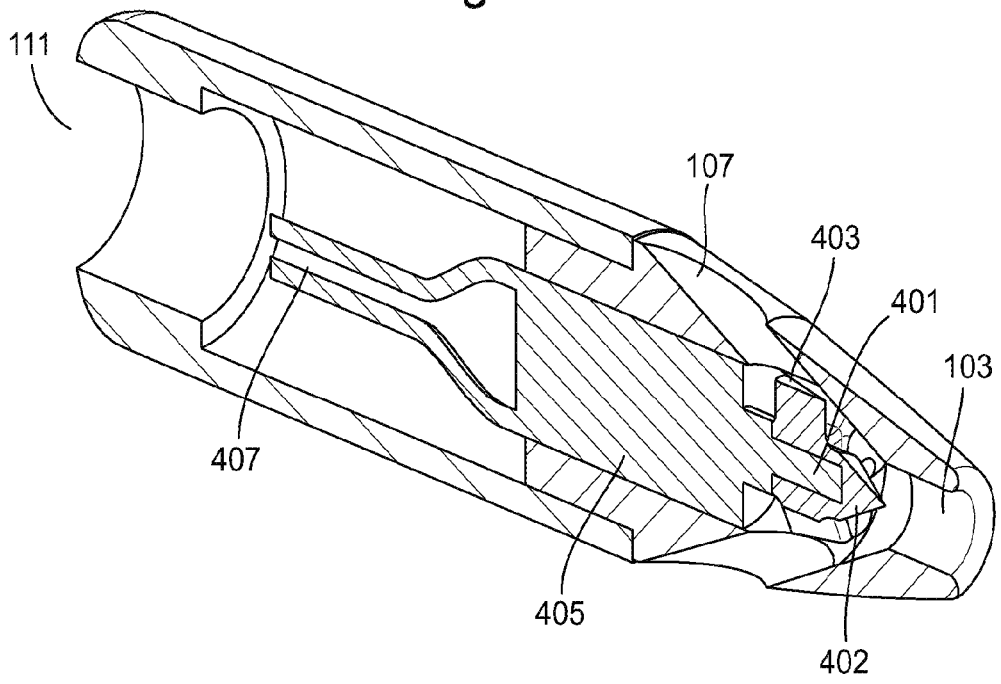

FIG. 4 is a schematic representation of a projectile according to an example. The projectile of FIG. 4 is shown in a perspective, cut-away, view. In the example of FIG. 4, turbine 119 is depicted in greater detail. More specifically, shaft 401 is configured to receive turbine blades 403. In an example, the blades have a relatively shallow angle or pitch, such as an angle in the range 20-30 degrees. This ensures that the turbine can function without degradation due to the force of air flow upon the turbine causing it to rotate beyond operational tolerances. In an example, the blades 403 of the turbine are provided as part of a monolithic structure mounted to the shaft 401, which may comprise a pointed or generally conical end portion 402. In the presence of an airflow over the blades 403 the shaft 401 will be caused to rotate (as it is attached to or part of the structure comprising the blades), thereby enabling generation of an electrical current in generator 405, which can comprise (not shown for the sake of clarity) a rotor and stator arrangement configured to generate electricity as one element moves relative to the other. The current generated can be used to power a component 121 via, e.g., line feeds 407.

Figure 5:
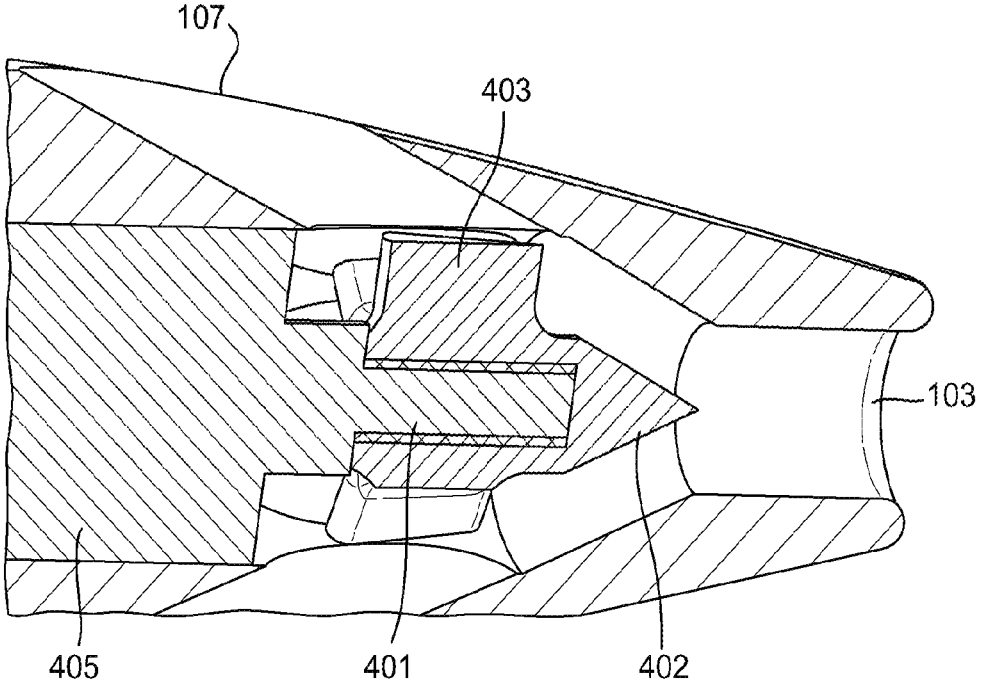
FIG. 5 is a schematic representation of a portion of a projectile according to an example.

FIG. 5 is a schematic representation of a portion of a projectile according to an example. The projectile of FIG. 5 is shown in a perspective, cut-away, view, and shows parts of the projectile of FIG. 4 in somewhat greater detail.

Turbine 119 can be in the form of an impeller type turbine, which is thus integrated into the projectile in order to harvest energy from the incident air flow of the projectile when in flight. This can be used to power, e.g, an LED light source that can form the component 121. In an example, the blades 403 can be manufactured from metal (such as aluminium or stainless steel for example) to ensure they are strong enough to operate in a ballistic environment.

Advantageously, the turbine 119 is provided at the tip 105 of the projectile in order to keep more weight at the front (since it would typically be replacing a lead weight that is normally in this position).

According to an example, the number of outlets 107 is different to number of turbine blades 403 since deconstructive air turbulence effects will occur if there is the same number of these elements. In an example, the number, n, of turbine blades, is greater than the number, m, of outlets. That is, $n \neq m$, and $n > m$, however, $n \neq m$, and $n < m$ is also a valid configuration.

Generally speaking, a projectile propelled from the barrel of a gun will rotate around an axis due to rifling within the barrel. This introduces gyroscopic inertia or stability to the projectile. According to an example, turbine 119 is configured to rotate in the opposite direction to the projectile in order to ensure that the turbine and motor assembly does not fail by exceeding its operational tolerances. If configured to rotate in the same direction s that of the projectile, the rate of rotation may exceed 100,000 rpm. However, if the projectile is spinning in the opposite direction then it will spin up to 10,000 rpm which is more than sufficient for power generation of small motors providing approximately 0.3 W. In an example, the direction of rotation can be configured by biasing/selecting the angle of blades of the turbine such that rotation occurs in a desired direction in the presence of an airflow. That is, the blades of the turbine are so configured as to provoke rotation in the presence of an airflow in an angular direction that is opposite to that of the spin imparted on the projectile by, e.g., rifling.

Referring to FIG. 4 or 5 for example, the angle of the outlets (relative to the axis A for example) is such that it minimises air turbulence and drag of exhaust air through the turbine 119 along the body of the projectile when in flight. That is, outlets 107 are angled towards the base III of the projectile.

According to an example, the presence of air upon the turbine 119 when the projectile is fired can act as a triggering mechanism. That is, since the turbine 119 will not generate power until the projectile is in flight and this there is sufficient airflow through the airflow channel structure 117, any electronic component 121 to be powered via turbine 119 will not operate until the projectile is propelled. This therefore obviates the need for a separate triggering system, which may be required when, e.g. a battery is used to power a component of the projectile.

According to an example, component 121 can comprise an illumination source configured to emit electromagnetic (EM) radiation in the visible, UV or infra-red region of the EM spectrum.

The invention claimed is:

1. A non-incendiary projectile tracer comprising an energy harvesting assembly, the projectile comprising:

an inlet provided at a tip of a casing of the projectile;

multiple outlets provided circumferentially around an outer surface of the casing proximate the tip;

a turbine having a monolithic structure with a plurality of turbine blades and a conical end portion, the conical end portion mounted to a shaft configured to receive the turbine blades;

an airflow channel structure extending from the inlet in a generally axial direction through the turbine to the multiple outlets such that air passes over the conical end portion of the monolithic structure of the turbine;

a generator coupled to the turbine via the shaft, the generator configured to convert energy from the turbine into electrical energy; and an electronic component configured to be powered by the electrical energy, wherein the projectile tracer is non-incendiary.

2. The projectile tracer of claim 1, wherein the inlet is arranged along an axial direction of the projectile.

3. The projectile tracer of claim 1, wherein the outlets are provided at respective terminal ends of multiple outlet channels of the assembly, each outlet channel being arranged at an obtuse angle with respect to an axis of the projectile.

4. The projectile tracer of claim 1, wherein the turbine comprises n turbine blades, and $n \neq m$, wherein m is a number of outlets.

5. The projectile tracer of claim 4, wherein the turbine blades have a pitch in the range 15-30 degrees.

6. The projectile tracer of claim 1, wherein the turbine is so arranged as to rotate in a predetermined direction of rotation that is the same as a direction of rotation of the projectile, in use.

7. The projectile tracer of claim 1, wherein the multiple outlets are arranged at an angle relative to the axis of the projectile.

8. The projectile tracer of claim 7, wherein the outlets are defined by channels of the airflow channel structure, terminating in apertures in the outer surface of the casing.

9. The projectile tracer of claim 1, further comprising a mesh structure provided over or within the inlet.

10. The projectile tracer of claim 1, wherein the electronic component comprises an illumination source configured to emit electromagnetic radiation from an aperture in a base of the projectile.

11. The projectile tracer of claim 1, wherein the turbine is configured to rotate in a predefined direction, which direction is opposite to a direction of rotation of the projectile.

12. A non-incendiary projectile tracer comprising an energy harvesting assembly, the projectile comprising:

an inlet provided at a tip of a casing of the projectile;

a number m of outlets provided circumferentially around an outer surface of the casing proximate the tip;

a turbine having a monolithic structure with a plurality of turbine blades and a conical end portion, the conical end portion mounted to a shaft configured to receive the turbine blades, the turbine including a number n of blades extending from the shaft, the blades having a pitch in the range 15-30 degrees, wherein n and m are both greater than 1, and $n \neq m$;

an airflow channel structure extending from the inlet through the turbine to the multiple outlets such that air passes over the conical end portion of the monolithic structure of the turbine;

a generator coupled to the turbine via the shaft, the generator configured to convert energy from the turbine into electrical energy;

a rearward-facing aperture; and an electronic component including an illumination source proximate the rearward-facing aperture and configured to be powered by the electrical energy, wherein the projectile tracer is non-incendiary.

13. The projectile tracer of claim 12, wherein the inlet defines an intake for an internal inlet channel of the assembly arranged along an axial direction of the projectile, and wherein the outlets are provided at respective terminal ends of multiple outlet channels of the assembly, each outlet channel being arranged at an obtuse angle with respect to an axis of the projectile.

14. The projectile tracer of claim 12, further comprising a mesh structure provided over or within the inlet.

* * * * *